United States Patent [19]

Bachmann et al.

[11] Patent Number: 4,619,444

[45] Date of Patent: Oct. 28, 1986

[54] ARRANGEMENT FOR PREVENTING AIR FROM REACHING ABUTTING SLIDING SURFACES OF ROTARY SLIDING CLOSURE UNIT

[75] Inventors: Herbert Bachmann, Lucerne; Karl-Otto Hornung, Hombrechtikon, both of Switzerland

[73] Assignee: Stopinc Aktiengesellschaft, Baar, Switzerland

[21] Appl. No.: 733,575

[22] Filed: May 13, 1985

[30] Foreign Application Priority Data

May 23, 1984 [CH] Switzerland ..... 2533/84

[51] Int. Cl.[4] ..... B22D 41/08

[52] U.S. Cl. ..... 266/236; 266/287; 222/598

[58] Field of Search ..... 266/287, 236, 271; 222/600, 599, 598, 601, 597

[56] References Cited

U.S. PATENT DOCUMENTS 4,385,715 5/1983 Meier et al. ..... 222/598
4,480,770 11/1984 Goursat et al. ..... 222/600

FOREIGN PATENT DOCUMENTS 1417824 12/1975 United Kingdom ..... 222/598

*Primary Examiner*—L. Dewayne Rutledge
*Assistant Examiner*—S. Kastler
*Attorney, Agent, or Firm*—Wenderoth, Lind & Ponack

[57] ABSTRACT

A rotary sliding closure unit includes stationary and rotary refractory members having respective discharge openings and fixed and rotary mounting devices for supporting the respective refractory members. The rotary member is rotated by the rotary mounting device with respect to the stationary refractory member along respective complementary abutting sliding surfaces thereof. Air is prevented from contacting the abutting sliding surfaces by an annular chamber defined between the fixed and rotary mounting devices and closed by an annular seal positioned therebetween.

8 Claims, 2 Drawing Figures

ARRANGEMENT FOR PREVENTING AIR FROM REACHING ABUTTING SLIDING SURFACES OF ROTARY SLIDING CLOSURE UNIT

BACKGROUND OF THE INVENTION

The present invention relates to an improvement in a rotary sliding closure unit and specifically to an arrangement for preventing air from reaching abutting sliding surfaces of refractory members of such unit.

More specifically, the present invention relates to such improvement in a rotary sliding closure unit for controlling the discharge of molten metal from a metallurgical vessel, the unit being of the type including a stationary refractory member having a discharge opening, fixed mounting means for supporting the stationary refractory member at a position with the discharge opening thereof in alignment with an outlet of the metallurgical vessel, a rotary refractory member having a discharge opening, and rotary mounting means for supporting the rotary refractory member in abutment with the stationary refractory member along respective complementary abutting sliding surfaces and for rotating the rotary refractory member with respect to the stationary refractory member between an open position whereat the discharge openings are in alignment and a closed position whereat the discharge openings are out of alignment. This general type of rotary sliding gate or rotary sliding closure unit is disclosed in European patent specification No. 00 40692.

In this type of unit, the refractory closing components or members slide relative to each other under an initial stress and are subjected to considerable wear due to the rotation of the rotary refractory member at elevated temperatures while being acted upon by the molten metal. A number of attempts have been made in the past to reduce the amount of wear of the refractory members to thereby increase the service life of the closure unit. For example, attempts have been made to employ selected combinations of materials of the refractory members which slide relative to each other. However, such attempts have lead to an additional problem, namely a reduction in resistance to oxidation and a decrease in sliding properties of the refractory members.

SUMMARY OF THE INVENTION

With the above discussion in mind, it is an object of the present invention to provide an improvement in rotary sliding closure units of the above described type, whereby it is possible to overcome the above and other prior art disadvantages.

It is a further object of the present invention to provide such a unit whereby it is possible to prevent, or at least to substantially reduce, oxidation and thereby premature destruction of the refractory members which slide relative to each other.

These objects are achieved in accordance with the present invention by the provision of means for preventing air from contacting the abutting sliding surfaces of the stationary and rotary refractory members, such preventing means comprising the formation between the fixed and rotary mounting means of an annular gap radially surrounding the abutting sliding surfaces of the stationary and rotary refractory members, and seal means positioned between the fixed and rotary mounting means for sealing the annular gap and thereby for defining a closed annular chamber radially surrounding the abutting sliding surfaces and isolated from exterior air.

Thus, the present invention is based upon the discovery that the destruction of the refractory members sliding relative to each other at elevated temperatures in the area of the abutting sliding surfaces primarily is caused by oxidation or combustion processes due to the presence of oxygen. The supply of exterior air and thereby oxygen to the abutting sliding surfaces is cut off due to the formation of the sealed annular chamber radially surrounding the abutting sliding surfaces. This prevents oxidation in the area of the abutting sliding surfaces, and thereby the service life of the refractory members is increased. Another advantage of the structural arrangement of the present invention is that the sealed annular chamber prevents, during a teeming process, air from being sucked into the discharge passage by an injector action along the members, with the result that oxidation of the melt being discharged thereby is avoided. Furthermore, the sealed annular chamber provides an arrangement to minimize downstream losses while protective gas is being supplied to the environment of the refractory members.

BRIEF DESCRIPTION OF THE DRAWINGS

Other objects, features and advantages of the present invention will be described in more detail below with reference to the accompanying drawings, wherein.

DETAILED DESCRIPTION OF THE INVENTION

Figure 1:
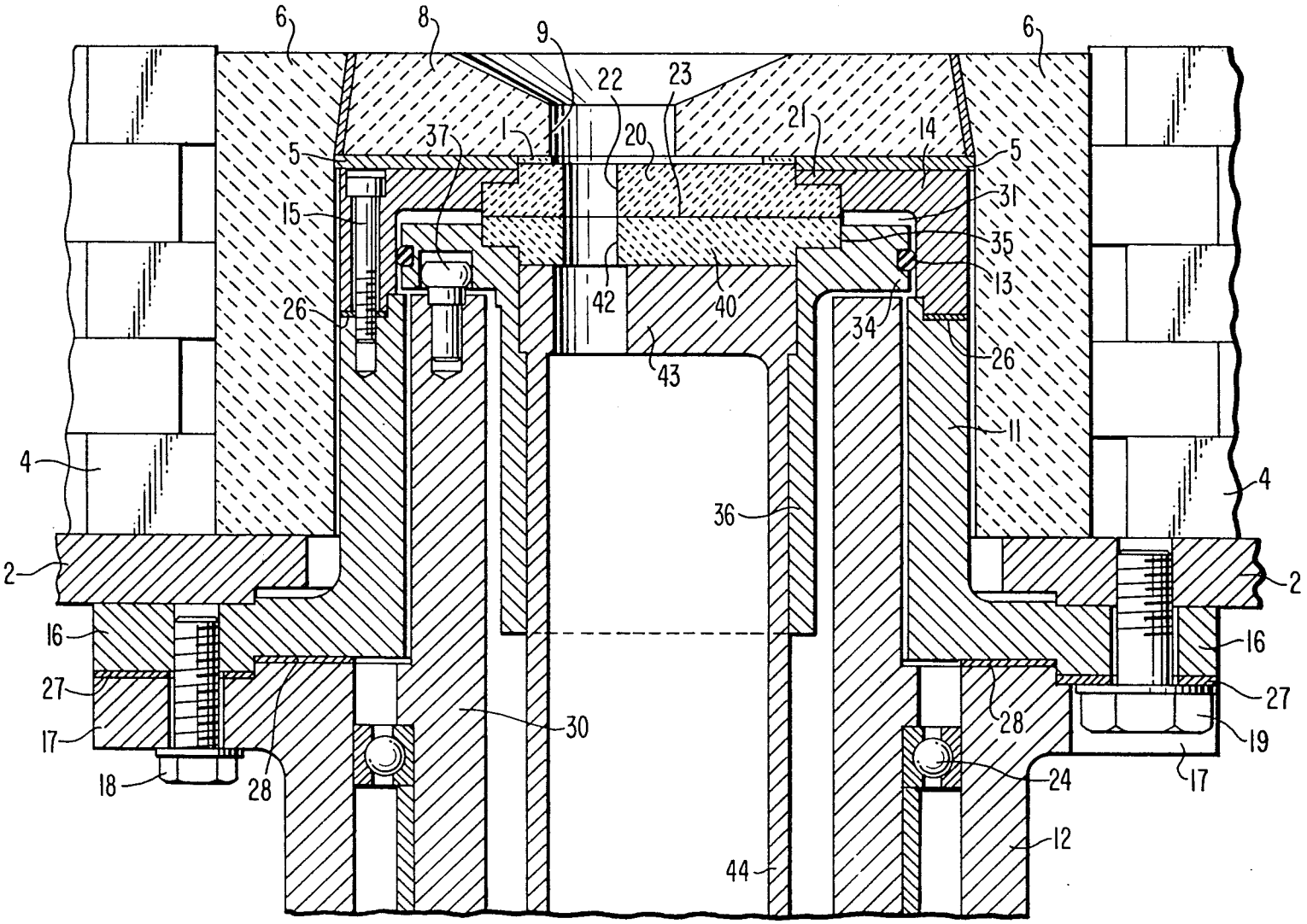
FIG. 1 is a partial longitudinal section through a metallurgical vessel equipped with a rotary sliding closure unit according to one embodiment of the present invention.

In FIG. 1 is shown the portion of the bottom of a metallurgical vessel adapted to contain a molten metal and including a metal jacket 2 and a refractory lining 4. Within an opening in jacket 2 and lining 4 is positioned a refractory shell 6 having mounted therein a runner or discharge brick 8 having therein a funnel like outlet opening 9 for discharge of molten metal from the vessel.

Fitted within the shell 6 and attached to the jacket 2 is a rotary sliding closure unit which generally includes a stationary refractory member 20 having a discharge opening 22, fixed mounting means 14, 11, 12 for supporting stationary refractory member 20 at a position with discharge opening 22 thereof in alignment with outlet opening 9, a rotary refractory member 40 having a discharge opening 42, and rotary mounting means 34, 43, 30 for supporting rotary refractory member 40 in abutment with stationary refractory member 20 along respective complementary abutting sliding surfaces 23 and for rotating rotary refractory member 40 with respect to stationary refractory member 20 between an open position (shown in FIG. 1) whereat discharge openings 22, 42 are in alignment to provide for discharge of molten metal and a closed position whereat discharge openings 22, 42 are out of alignment.

More specifically, refractory members 20, 40 are of general plate shape as shown and as is conventional. The upper end face of plate 20 is separated from the underside of runner brick 8 by an annular mortar joint 1. Outwardly of joint 1 is an annular insulation layer 5 between the underside of runner brick 8 and an upper side of a stationary ring support 14 which peripherally surrounds and holds plate 20. Connected to the bottom of ring support 14, for example by bolts 15, is a longitudinal tubular section 11 which has a lower, outwardly extending annular flange 16, whereby the closure unit as a whole is connected to jacket 2 by means of bolts 19. Connected to flange 16, for example by bolts 18, is a flange 17 of a lower longitudinal tubular section 12. Positioned between flanges 16, 17 is a heat insulation layer 27, positioned between tubular sections 11 and 12 is a heat insulation layer 28, and positioned between ring support 14 and tubular section 11 is a heat insulation layer 26. These heat insulation layers greatly restrict heat dissipation to the exterior.

Peripherally surrounding and holding the rotary plate 40 is intermediate member 34 of the rotary mounting means. Member 34 has an axially downwardly extending flange 36 which surrounds and supports a lower mounting member 43 having a downwardly extending discharge nozzle 44. Positioned within the fixed mounting means is a rotary tube member 30 which coaxially surrounds flange 36 and nozzle 44. On the axially inner end face of tube member 30 are inserted a plurality of carrier or driver members 37 which fit within respective recesses of intermediate member 34. Tube member 30 is rotatably mounted within tubular section 12 by means of a bearing or bearings 24, and tube member 30 is adapted to be rotated in a known manner by a drive (not shown). This rotation is transmitted by members 37 to intermediate member 34 and thereby to rotary plate 40.

In accordance with the present invention, there is provided means for preventing air from contacting abutting sliding surfaces 23 of the stationary and rotary plates 20, 40, thereby to prevent oxidation and combustion reactions thereat. Thus, in accordance with the present invention, the fixed and rotary mounting means define therebetween an annular gap which radially surrounds the abutting sliding surfaces 23. A seal 13 is positioned between the fixed and rotary mounting means and seals the annular gap to thereby define a closed annular chamber 31 which radially surrounds the abutting sliding surfaces 23 and which thereby is isolated from the exterior air.

More particularly, the ring support 14 and the intermediate member 34 have respective annular and generally radially extending surfaces which are spaced axially from each other and which define therebetween a generally radially extending gap portion. Ring support 14 peripherally surrounds intermediate member 34 and is spaced therefrom, such that spaced surfaces thereof define therebetween an annular generally axially extending gap portion. The axially extending gap portion extends substantially perpendicular to a plane containing abutting sliding surfaces 23. The seal 13 is located in the axially extending gap portion. Specifically, annular seal 13 is fitted in an annular groove formed in the exterior axially extending annular surface of intermediate member 34 and sealingly abuts the inner axially extending annular surface of ring support 14. It is of course possible that the seal 13 could be fitted in a similar groove formed in ring support 14. It thereby will be apparent that annular chamber 31 which peripherally surrounds the abutting sliding surfaces 23 is sealed from exterior air.

Figure 2:
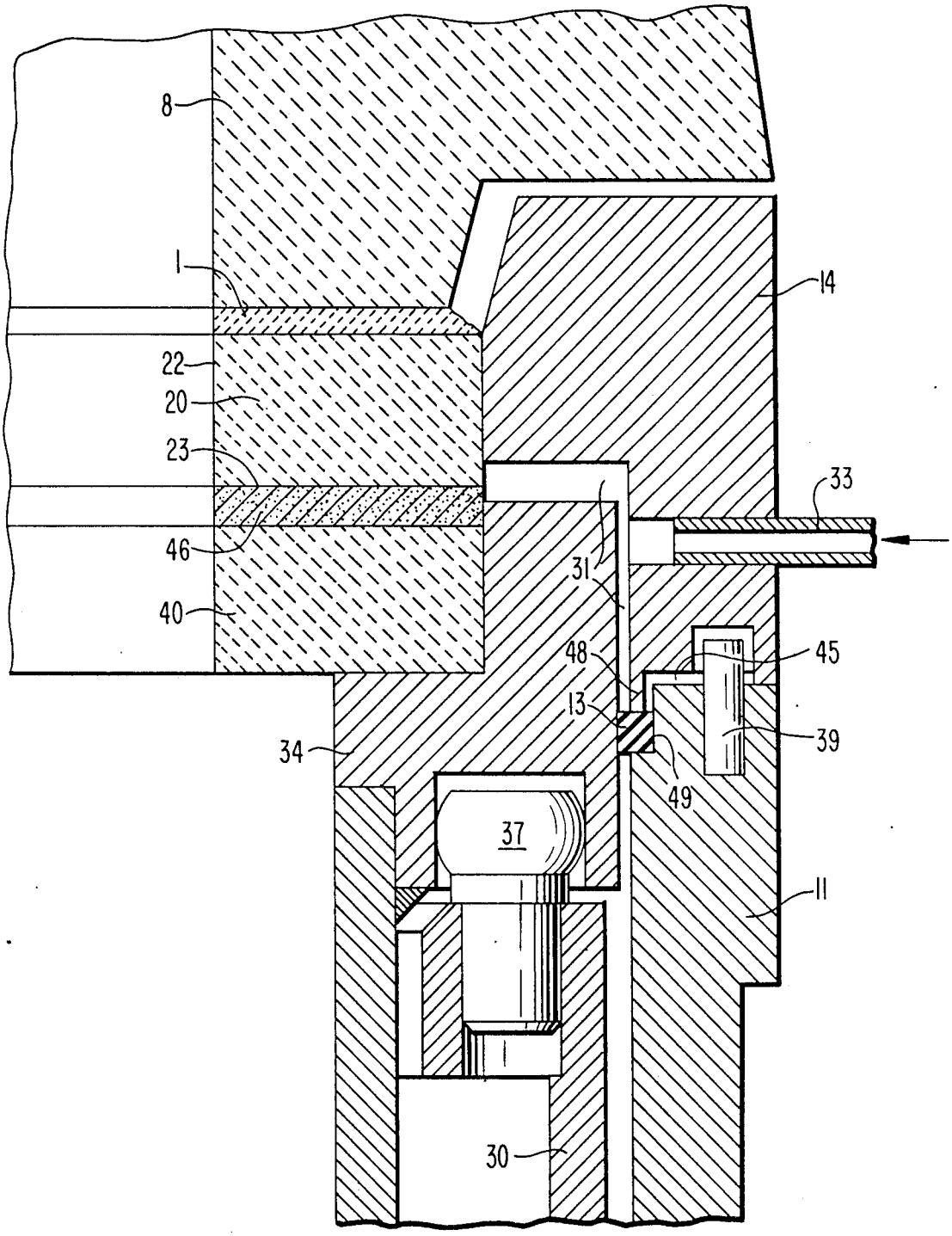
FIG. 2 is a partial section, on an enlarged scale, showing a second embodiment of the present invention, as well as other modifications thereof.

FIG. 2 shows a modified embodiment wherein there is provided an axial gap 45 between the lower end of ring support 14 and the upper end of tubular section 11. A groove or recess 49 is formed in the inner axially extending annular surface of tubular section 11 at the area of axial separation between section 11 and ring support or section 14. Ring support 14 has an inner annular, downwardly extending lip 48. Seal 13 is fitted within recess 49 and is axially compressed by lip 48 when elements 14, 11 are axially secured together, for example by screws 15. To ensure proper relative positioning of elements 14, 11, at least one pin 39 is provided, for example by being rigidly inserted in section 11 and extending into an appropriate recess in ring support 14. Seal 13 is compressed by lip 48 and thereby is caused to bear radially inwardly against the rotary intermediate member 34. Thereby, the annular chamber 31 is closed to exterior air, and as a result the abutting sliding surfaces 23 are isolated from such exterior air.

FIG. 2 illustrates another modification which may be incorporated into the embodiment of FIG. 1. Thus, rotary refractory plate 40 is provided with an upper layer 46 of a material, such as graphite or similar material, having good sliding properties. The respective complementary abutting sliding surfaces thus are formed between stationary refractory plate 20 and layer 46. It is to be understood however that layer 46 may be provided alternatively on plate 20, or further alternatively both plates 20, 40 could be provided with such a sliding layer.

FIG. 2 also illustrates a further modification of the present invention which also may be incorporated in the embodiment of FIG. 1. Thus, an inlet pipe 33 extends through ring support 14 to enable a protective gas to be introduced into annular chamber 31, thereby further protecting abutting sliding surfaces 23. Downstream losses substantially are prevented by seal 13.

Although the present invention has been described and illustrated with respect to preferred embodiments thereof, it is to be understood that various modifications and changes to the specifically described and illustrated features may be made without departing from the scope of the present invention.

We claim:

1. In a rotary sliding closure unit for controlling the discharge of molten metal from a metallurgical vessel, said unit being of the type including a stationary refractory member having a discharge opening, fixed mounting means for supporting said stationary refractory member at a position with said discharge opening adapted to be in alignment with an outlet of a metallurgical vessel, a rotary refractory member having a discharge opening, and rotary mounting means for supporting said rotary refractory member in abutment with said stationary refractory member along respective complementary abutting sliding surfaces and for rotating said rotary refractory member with respect to said stationary refractory member between an open position whereat said discharge openings are in alignment and a closed position whereat said discharge openings are out of alignment, the improvement comprising means for preventing air from contacting said abutting sliding surfaces of said stationary and rotary refractory members, said preventing means comprising:

said fixed and rotary mounting means defining therebetween an annular gap radially surrounding said abutting sliding surfaces; and compressible seal means positioned at a location spaced from said abutting sliding surfaces and bearing against said fixed and rotary mounting means for sealing said annular gap and thereby defining a closed annular chamber radially surrounding said abutting sliding surfaces and isolated from exterior air.

2. The improvement claimed in claim 1, wherein said closed annular chamber includes a gap portion extending generally radially outwardly from said abutting sliding surfaces and a gap portion extending generally axially from said radially extending gap portion and generally perpendicularly of a plane containing said abutting sliding surfaces.

3. The improvement claimed in claim 2, wherein said seal means is located in said axially extending gap portion.

4. The improvement claimed in claim 2, wherein said rotary mounting means includes a rotary annular member peripherally surrounding and holding said rotary refractory member, said fixed mounting means includes a fixed annular member peripherally surrounding and holding said stationary refractory member and peripherally surrounding said rotary annular member, said fixed and rotary annular members having respective annular, generally radially extending surfaces spaced from each other to define therebetween said radially extending gap portion, and said fixed and rotary annular members having respective annular, generally axially extending surfaces spaced from each other to define therebetween said axially extending gap portion.

5. The improvement claimed in claim 4, wherein said seal means comprises an annular seal fitted in an annular groove formed in one of said axially extending surfaces and sealingly abutting the other said axially extending surface.

6. The improvement claimed in claim 4, wherein said fixed annular member comprises two axially separated sections, said seal means comprises an annular seal fitted into an annular groove formed in said axially extending surface of one said section at the area of axial separation between said sections, and the other said section includes an annular lip bearing on and axially compressing said seal and deforming said seal into sealing abutment with said axially extending surface of said rotary annular member.

7. The improvement claimed in claim 4, further comprising means extending through said fixed annular member for introducing a protective gas into said closed annular chamber.

8. The improvement claimed in claim 1, further comprising means for introducing a protective gas into said closed annular chamber.

* * * * *